United States Patent [19]

Englund

[11] Patent Number: 5,063,750

[45] Date of Patent: Nov. 12, 1991

[54] ROTARY POSITIVE DISPLACEMENT COMPRESSOR AND REFRIGERATION PLANT

[75] Inventor: Arnold Englund, Spånga, Sweden

[73] Assignee: Svenska Rotor Maskiner AB, Stockholm, Sweden

[21] Appl. No.: 613,561

[22] PCT Filed: May 29, 1989

[86] PCT No.: PCT/SE89/00299

§ 371 Date: Nov. 27, 1990

§ 102(e) Date: Nov. 27, 1990

[87] PCT Pub. No.: WO89/12752

PCT Pub. Date: Dec. 28, 1989

[30] Foreign Application Priority Data

Jun. 17, 1988 [SE] Sweden ..... 8802274

[51] Int. Cl.[5] ..... F01C 1/16

[52] U.S. Cl. ..... 62/196.3; 62/510; 418/201.2

[58] Field of Search ..... 62/196.3, 510, 505; 418/201.2

[56] References Cited

U.S. PATENT DOCUMENTS

| | | | |
|---|---|---|---|
| 3,568,466 | 3/1971 | Brandin et al. | 62/510 |
| 3,913,346 | 10/1975 | Moody, Jr. et al. | 62/197 |
| 4,727,725 | 3/1988 | Nagata et al. | 418/201.2 X |
| 4,748,831 | 6/1988 | Shaw | 62/505 |
| 4,799,865 | 1/1989 | Oscarsson | 418/201.2 X |

FOREIGN PATENT DOCUMENTS

| | | |
|---|---|---|
| WO86/06798 | 11/1986 | PCT Int'l Appl. . |
| WO87/03651 | 6/1987 | PCT Int'l Appl. . |
| 338576 | 9/1971 | Sweden . |

*Primary Examiner*—William E. Wayner

*Attorney, Agent, or Firm*—Frishauf, Holtz, Goodman & Woodward

[57] ABSTRACT

The rotary positive displacement compressor has an intermediate port (42) for fluid from an intermediate pressure channel (30) and has a bleed port (44) for recirculation of partly compressed fluid through a return channel (32). It is suggested to provide the compressor with valve means (36), selectively adjustable between two end positions. In a first end position it opens up a direct communication between these channels (30, 32) and opens the bleed port (44), whereby fluid flows directly from the intermediate pressure channel (30) to the return channel (32) simultaneously as fluid within the working space of the compressor flows to the return channel (32) through the intermediate port (42) as well as through the bleed port (44). In a second end position the bleed port (44) is closed and said direct communication is blocked. The disclosure also relates to a refrigeration plant comprising such a compressor.

16 Claims, 2 Drawing Sheets

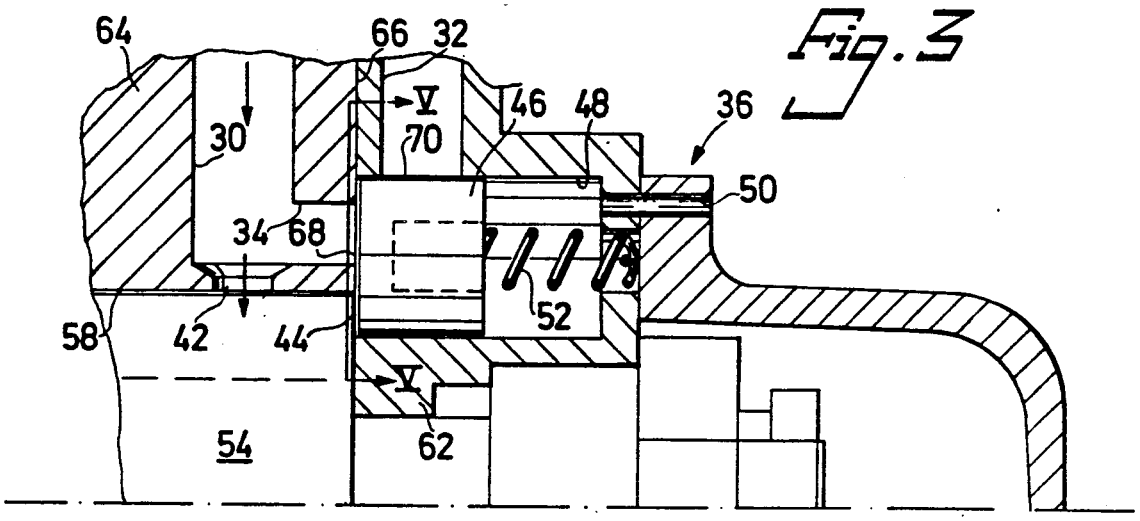
Fig. 3
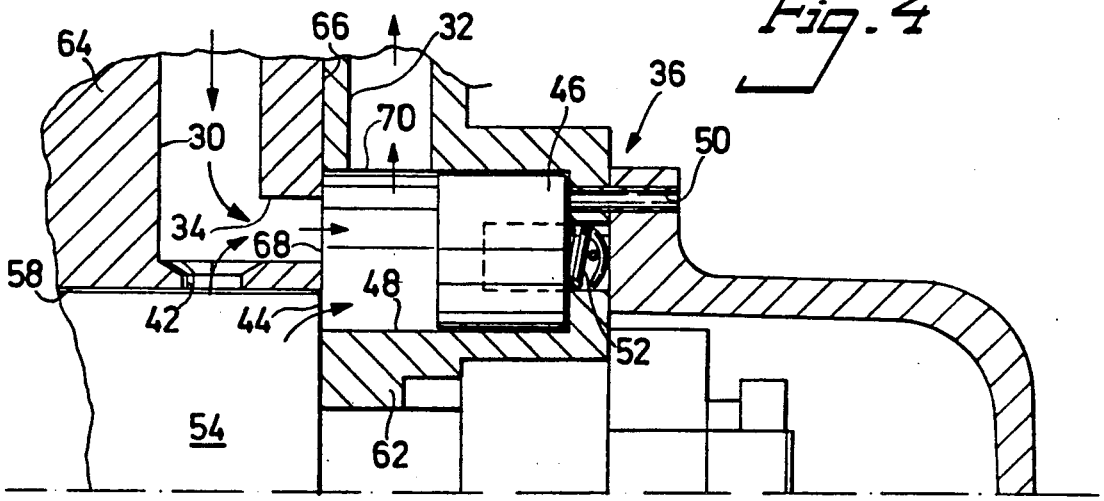
Fig. 4
Fig. 5
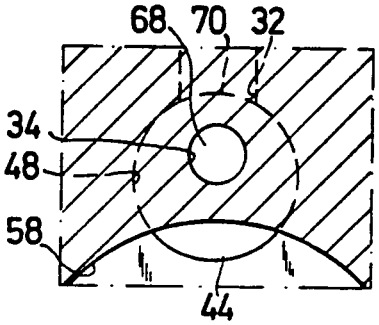
Fig. 6
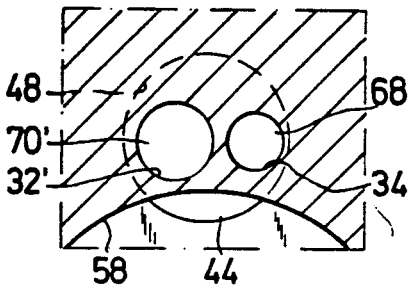

ROTARY POSITIVE DISPLACEMENT COMPRESSOR AND REFRIGERATION PLANT

BACKGROUND OF THE INVENTION

The present invention relates to a rotary positive displacement compressor comprising at least one rotor forming compression chambers in a working space, the compressor having an inlet port communicating with a low pressure channel, an outlet port communicating with a high pressure channel, intermediate port means communicating with an intermediate pressure channel and bleed port means selectively connectable to said low pressure channel through a return channel, said intermediate port means and said bleed port means being located such that they face a compression chamber within said working space in a compression chamber, which chamber is sealed from communication with said inlet port as well as said outlet port by said at least one rotor.

The invention further relates to a plant of refrigeration type comprising such a compressor and having a condenser communicating with said high pressure channel, an evaporator communicating with said low pressure channel, a vessel for an intermediate pressure communicating with said intermediate pressure channel, a channel connecting said condenser to said vessel, said channel having first pressure reducing means for decreasing the high pressure in said condenser to the intermediate pressure in said vessel and a channel connecting said vessel to said evaporator, said channel having second pressure reducing means decreasing the intermediate pressure in said vessel to the low pressure in said evaporator.

A compressor and a plant of such types are earlier known from U.S. Pat. No. 3,913,346. The intermediate pressure zone in such plants is used for internal cooling purposes within the plant at a temperature level above that of the evaporator. The main cooling purpose is to precool the liquified refrigerant before the supply thereof to the evaporator which results in a more effective use of the evaporator area so that the dimensions thereof can be minimized for a certain capacity simultaneously as the swept volume of the compressor and thus its dimensions can be reduced correspondingly. Furthermore the power required for recompression of the gaseous refrigerant supplied at the intermediate pressure will be less than that if all the refrigerant were supplied at the evaporator pressure.

In order to vary the volumetric capacity the compressor in U.S. Pat. No. 3,913,346 is provided with a selectively adjustable valve controlling a bleed port in the wall of the working space so that a certain amount of the working fluid supplied to the compressor may be returned to the inlet channel of the compressor. This bleed port is disposed within the same phase of the compression cycle as the intermediate port means. When the bleed port is opened the pressure level inside the compressor working space decreases to such an extent that the back pressure within the area of the intermediate port means will be practically the same as that in the low pressure channel. The bleed port must in order to avoid throttling losses be provided with a large area corresponding to what is required not only for the recirculation of the surplus fluid supplied through the inlet port but also for draining the fluid supplied through the intermediate port means. The size of the valve member will thus be too large for location in the end wall with regard to its area compared with the limited space available outside the rotor bearings. For this reason the valve has to be located in the barrel wall of the working space. Such a valve will consequently be complicated in shape and expensive to manufacture as it not only has to sealingly cooperate with its seat in the housing but also has to sealingly cooperate with the confronting rotor or rotors in order to avoid internal leakage within the compressor, especially when running under maximum capacity conditions.

In the PCT-application with International Publication Number W086/06798 a compressor is disclosed, where the discussed problems related to a compressor and a refrigeration plant of the type in question are overcome by providing a connection controlled by a selectively adjustable over-flow valve between the intermediate pressure channel and the low pressure channel. In this way the need for a separate bleed port is eliminated as the intermediate port means will act as such a port during low volumetric capacity conditions when only the surplus supplied working fluid has to be drained from the working space.

The main object of the present invention is to reach an alternative solution to overcome these problems so as to achieve a more effective capacity control of the compressor per se as well as of a complete refrigeration plant by means of simpler and less expensive valve arrangement than those used in the prior art.

According to one aspect of the invention this object is attained by providing a compressor of the introductionally specified kind with valve means, selectively adjustable between two end positions for formation of different flow paths within the compressor, in the first end position said valve means opens up a direct communication between said intermediate pressure channel and said return channel and opens said bleed port means, whereby fluid flows directly from the intermediate pressure channel to the return channel simultaneously as fluid within the working space flows to the return channel through the intermediate port means as well as through the bleed port means, whereas in the second end position said valve means blocks said direct communication between said intermediate pressure channel and said return channel and closes said bleed port means.

According to another aspect of the invention this object is attained by providing a refrigeration plant of the introductionally specified kind with valve means as specified above.

The main advantage with a compressor and a refrigeration plant according to the invention is the possibilty to optimize the areas of the bleed port means and the intermediate port means, thereby allowing greater freedom for their location and admitting less complicated valve constructions for the bleed port means. The area of the intermediate port means is determined only by what is required for the passage of the intermediate pressure fluid from the intermediate pressure channel to the compressor. At reduced capacity condition when the valve means is in the first end position a part of the partly compressed fluid which is to be recirculated to the inlet flows through the intermediate port means to the return channel. The bleed port means thus can be dimensioned to take care of only the remaining part of the fluid to be recirculated.

Further objects of the invention and how those are met will become apparent from the detailed description given hereinafter. However, it should be understood that the detailed description and specific examples, while indicating preferred embodiments of the invention, are given by way of illustration only, since various changes and modifications within the scope of the invention will become apparent to those skilled in the art from this detailed description.

The present invention will become more fully understood from the detailed description given hereinbelow and the accompanying drawings

BRIEF DESCRIPTION OF THE DRAWINGS

FIG. 3 is a detailed section through a part of a compressor according to the invention showing the valve means in the second end position, FIG. 4 is a section similar to FIG. 3, but showing the valve means in the first end position, FIG. 5 is a section taken along line V—V in FIG. 3, and FIG. 6 is a section similar to FIG. 5, but showing another embodiment.

DETAILED DESCRIPTION

Figure 1:
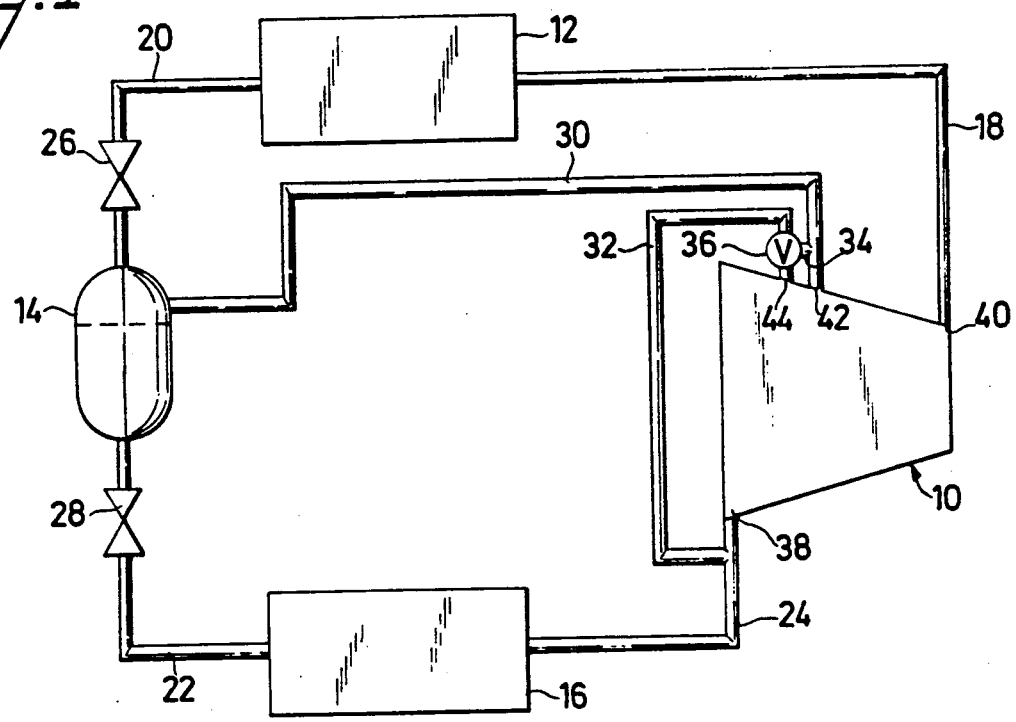
FIG. 1 diagramatically illustrates an embodiment of a refrigeration plant according to the invention.

A refrigeration plant as shown in FIG. 1 comprises a compressor 10 communicating with a condenser 12 through a high pressure channel 18 connected to the outlet port 40 of the compressor and with an evaporator 16 through a low pressure channel 24 connected to the inlet port 38 of the compressor. The condenser 12 and the evaporator 16 are interconnected by channels 20, 22 in which two sets of pressure reduction means 26, 28 are disposed, each shaped as a throttling valve. An intermediate pressure vessel 14 in the shape of a flash chamber is disposed between the two throttling valves 26, 28. The flash gas side of the intermediate pressure vessel 14 communicates through an intermediate pressure channel 30 with intermediate port means 42 in the compressor 10.

The compressor 10 is provided with a return channel 32 ending in a bleed port 44 in the compressor and communicating with the low pressure channel 24. A branch channel 34 connects the intermediate pressure channel 30 and the return channel 32. A valve 36 is provided in the return channel 32, where the branch channel 34 ends in the return channel. The valve 36 has two end positions. In the first endposition the bleed port 44 is in communication with the low pressure channel 24 through the return channel 32, and in this position the branch channel 34 communicates with the return channel 32. In the second end position of the valve, communication through the return channel 32 is broken and the branch channel 34 does not communicate with the return channel 32.

Figure 2:
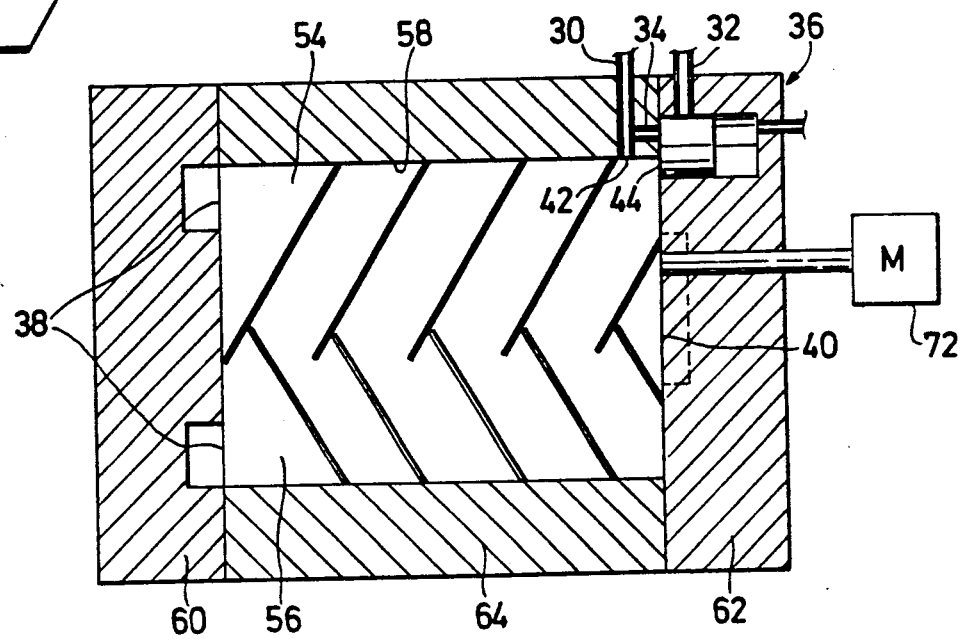
FIG. 2 is a schematic section through a compressor according to the invention.

The compressor 10, schematically shown in FIG. 2, is of the intermeshing screw type having a male rotor 54 and a female rotor 56, the male rotor 54 being driven by a motor 72. Each rotor is provided with helical lobes and intermediate grooves, through which the rotors 54, 56 intermesh, forming chevron-shaped compression chambers. The rotors are working in a working space 58 limited by a low pressure end section 60, in which the inlet port 38 is located, a high pressure end section 62, in which the outlet port 40 is located and a barrel section 64 extending therebetween.

The intermediate port means 42 is located in the barrel section 64 and the bleed port means 44 in the high pressure end section 62. These port means 42, 44 face the working space 58 in the same stage of the compression cycle, when the compression chamber by the rotors 54, 56 is closed off from communication with the inlet port 38 as well as with the outlet port 40.

FIGS. 3 and 4 show the bleed port means 44 and the intermediate port means 42 more in detail and how they cooperate with the selectively adjustable valve means 36 in the two positions thereof. The valve means 36 comprises a cylindrical valve member 46 displaceable in a bore 48 in the high pressure end section 62. One end of said bore 48 partly faces the working space 58, thereby forming the bleed port means 44, and partly is covered by the end surface 66 of the barrel section 64. The intermediate pressure channel 30, ending in the intermediate port means 42 is radially disposed in the barrel section 64. An axially directed branch channel 34 leads from the intermediate pressure channel 30 to the part of the barrel section end surface 66 covering a part of the bore 48 and faces the bore 48 through a first opening 68. The return channel 32 is radially disposed in the high pressure end section 62 and ends in the circumference of the bore 48 through a second opening 70. At the rear side of valve member 46 a pipe 50 for actuation fluid ends in the bore 48. This pipe 50 can be connected to either a high pressure source or a low pressure source. By a spring 52 the valve member 46 is biased towards its first end position.

A refrigeration plant according to the invention operates in the following way. Compressed gaseous working fluid is delivered from the compressor 10 to the condenser 12 where it is liquified by external cooling means. From the condenser 12 the liquified working fluid passes through the first throttling valve 26, whereby the pressure is reduced, to the intermediate pressure vessel 14 where the working fluid is partly evaporated as flash gas and the remaining liquified working fluid is cooled down to the evaporating temperature corresponding to the pressure in the intermediate pressure vessel 14. This cooled liquified working fluid passes through the second throttling valve 28 whereby the pressure is further reduced, to the evaporator 16 where the working fluid is evaporated by external heating means. The low pressure gaseous working fluid is then returned from the evaporator 16 to the compressor 10 inlet 38, recompressed and delivered to the condenser 12. The flash gas produced in the intermediate pressure vessel 14 is passed on to the intermediate pressure channel 30 communicating with the intermediate port means 42 in the wall of the working space 58 of the compressor 10.

At full capacity conditions of the plant the adjustable valve means 36 is in its second end position, in which there is no recirculation of working fluid from the bleed port means 44 to the low pressure channel 24, and in which the intermediate pressure fluid in the intermediate pressure channel cannot pass from the branch channel 34 to the return channel 32. The compressor 10 is filled to its maximum capacity by low pressure working fluid from the evaporator 16 through the inlet port 38 simultaneously as the intermediate pressure gas is supplied through the intermediate port means 42 to a compression chamber where the pressure has already been increased from the inlet port conditions. In this way the power for recompression of the gas supplied through the intermediate port means 42 is reduced as the compression thereof starts at a higher pressure level than the inlet pressure of the compressor. Simultaneously the full capacity of the compressor can be used for the gas from the evaporator which means that for a certain capacity of the plant the dimensions of the compressor can be reduced.

In order to achieve part load condition the valve means 36 is actuated to its first end position, forming communication between the bleed port means 44 and the low pressure channel 24 through the return channel 32 and forming communication between the branch channel 34 and the return channel 32. The fluid coming from the intermediate pressure vessel 14 thereby flows from the intermediate pressure channel 30 through the branch channel 34 to the return channel 32 and further to the low pressure channel 24. Simultaneously partly compressed fluid flows from the working space 58 to the low pressure channel via two different flow paths. One of them goes through the bleed port 44 and the return channel 32. The other one goes through the intermediate port means 42, the branch channel 34 and the return channel 32. The working fluid returned to the low pressure channel 24 replaces some of the gas otherwise sucked in from the evaporator 16 and thus reduces the capacity of the compressor so that the capacity of the plant is reduced. Since the bleed port means 44 has to take care of only a part of the working fluid to be recirculated, as a part thereof can pass through the intermediate port means 42, the opening area of the bleed port means 44 can be considerably reduced in comparence with known technique.

The function of the valve means 36 in a preferred embodiment of the invention can be understood from the detailed FIGS. 3 and 4. FIG. 3, in which the valve means 36 is in the second end position, illustrates the conditions when the compressor is running at full capacity. The flow of the intermediate pressure fluid through the intermediate pressure channel 30 and the intermediate port means 42 into the working space 58 of the compressor is indicated by arrows. It can be seen in the figure how in this position the front end surface of the valve member 46 covers the bleed port 44 and the first opening 68, where the branch channel 34 ends in the bore 48, and how the cylindrical surface of the valve member 46 covers the second opening 70, where the return channel reaches the bore 48. Thus no fluid is recirculated through the return channel 32, neither from the bleed port means 44, nor from the intermediate pressure channel 30. The valve member 46 is kept in the second end position by having: the pipe 50 connected to a high pressure source. This high pressure acts on the rear side of the valve member 46 against the action of the spring 52 and against the pressure acting on the front side thereof.

When the compressor is to be operated under part-load condition, the valve member 46 is actuated to the first end position, shown in FIG. 4, by connecting pipe 50 to a low pressure source. In this position the working space 58, the branch channel 34 and the return channel 32 all communicate with the bore 48 through the bleed port means 44, the first opening 68 and the second opening 70, respectively. As indicated by the arrows, fluid from the intermediate pressure channel 30 passes through the branch channel 34 to the bore 48, simultaneously as fluid in the working space 58 flows to the bore 48 partly through the bleed port means 44, partly through the intermediate port means 42 and the branch channel 34. From the bore 48 the fluid passes through the second opening 70 to the return channel 32 and further to the low pressure channel 24.

To avoid throttling losses the area of the first opening 68 should be larger than the area of the intermediate port means 42, and the area of the second opening 70 should be larger than the area of the first opening 68. By the same reason the area of the second opening 70 should exceed or equal the sum of the areas of the bleed port means 44 and first opening 68.

FIG. 5 shows the locations of the openings facing the bore 48 as seen in a section taken along line V-V in FIG. 3.

FIG. 6 illustrates in a corresponding section an alternative embodiment of how these openings and the channels connected thereto can be arranged. In this embodiment also the return channel 32' is disposed axially in the barrel section 64 and ends axially in the bore 48 through the second opening 70'.

I claim:

1. A rotary positive displacement compressor (10) comprising:

at least one rotor (54, 56) forming compression chambers in a working space (58);

an inlet port (38) communicating with a low pressure channel (24);

an outlet port (40) communicating with a high pressure channel (18);

intermediate port means (42) communicating with an intermediate pressure channel (30);

bleed port means (44) selectively connectable to said low pressure channel (24) through a return channel (32);

said intermediate port means (42) and said bleed port means (44) being located such that they face a compression chamber within said working space (58), which compression chamber is sealed from communication with said inlet port (38) as well as from said outlet port (40) by said at least one rotor (54, 56); and valve means (36), selectively adjustable between two end positions for formation of different flow paths, wherein in said first end position, said valve means (36) opens up a direct by-pass communication between said intermediate pressure channel (30) and said return channel (32) and opens said bleed port means (44), forming a first flow path as a by-pass flow path between said intermediate pressure channel (30) and said return channel (32), a second flow path between said working space (58) and said first flow path through said intermediate port means (42) and a third flow path between said working space (58) and said return channel through said bleed port means (44), and wherein in said second end position, said valve means (36) blocks said direct communication between said intermediate pressure channel (30) and said return channel (32) and closes said bleed port means (44), forming a flow path between said intermediate pressure channel (30) and said working space (58) through said intermediate port means (42).

2. Compressor according to claim 1, comprising two of said rotors (54, 56), each rotor (54, 56) being provided with helical lobes and intermediate grooves, through which said rotors (54, 56) intermesh, forming chevron-shaped compression chambers; and said working space (58) having the form of two intersecting circular cylinders and being limited by a high pressure end section (62), a low pressure end section (60) and a barrel section (64) extending therebetween.

3. Compressor according to claim 2, in which said intermediate port means (42) is disposed in said barrel section (64) and said bleed port means is disposed in said high pressure end section (62).

4. Compressor according to claim 3, in which said selectively adjustable valve means (36) is disposed in said high pressure end section (62) and comprising a cylindrical valve member (46) displaceable in a bore (48), one end of said bore (48) partly facing said working space (58) and partly being covered by the adjacent end surface (66) of said barrel section (64), the part facing the working space constituting said bleed port means (44), said intermediate pressure channel (30) communicating with said bore (48), through a first opening (68), said return channel (32, 32') ending in said bore (48) through a second opening (70, 70'), which valve member (46) in the first end position of the valve means uncovers said bleed port means (44) and said first (68) and second (70, 70') openings allowing working fluid to flow from said bleed port means (44) and said first opening (68) to said second opening (70, 70') and which valve member (46) in the second end position of the valve means covers said bleed port means (44) and said first (68) and second (70, 70') openings preventing any communication therebetween.

5. Compressor according to claim 4, in which said first (68) and second (70') openings are disposed in said end surface (66) of the barrel section (64) which partly covers said one end of said bore (48).

6. Compressor according to claim 5, in which said first opening (68) has a larger area than said intermediate port means (42), and said second opening (70, 70') has a larger area than said first opening (68).

7. Compressor according to claim 6, in which the area of said second opening (70, 70') is at least as large as the sum of the areas of said first opening (68) and said bleed port means (44).

8. Compressor according to claim 5, in which said valve member (46) is actuated by fluid pressure.

9. Compressor according to claim 4, in which said first opening (68) is disposed in said end surface (66) of the barrel section (64), which covers said one end of said bore (48), and said second opening (70) is radially disposed in said bore (48).

10. Compressor according to claim 9, in which said first opening (68) has a larger area than said intermediate port means (42), and said second opening (70, 70') has a larger area than said first opening (68).

11. Compressor according to claim 10, in which the area of said second opening (70, 70') is at least as large as the sum of the areas of said first opening (68) and said bleed port means (44).

12. Compressor according to claim 9, in which said valve member (46) is actuated by fluid pressure.

13. Compressor according to claim 4, in which said first opening (68) has a larger area than said intermediate port means (42), and said second opening (70, 70') has a larger area than said first opening (68).

14. Compressor according to claim 13, in which the area of said second opening (70, 70') is at least as large as the sum of the areas of said first opening (68) and said bleed port means (44).

15. Compressor according to claim 4, in which said valve member (46) is actuated by fluid pressure.

16. A refrigeration plant comprising:

a rotary positive displacement compressor (10);

a condenser (12) communicating with an outlet port (40) of said compressor through a high pressure channel (18);

an evaporator (16) communicating with an inlet port (38) of said compressor through a low pressure channel (24);

a vessel (14) for an intermediate pressure communicating with intermediate port means (42) of said compressor (10) through an intermediate pressure channel (30);

a first channel (20) connecting said condenser (12) to said vessel (14), said channel (20) having first pressure reduction means (26) for decreasing a high pressure in said condenser (12) to the intermediate pressure in said vessel (14);

a second channel (22) connecting said vessel (14) to said evaporator (16), said second channel (22) having second pressure reduction means (28) for decreasing an intermediate pressure in said vessel (14) to the low pressure in said evaporator;

said compressor (10) having at least one rotor (54, 56) forming compression chambers in a working space (58) and having bleed port means (44) selectively connectable to said low pressure channel (24) through a return channel (32);

said intermediate port means (42) and said bleed port means (44) being located such that they face a compression chamber within said working space (58), which compression chamber is sealed from communication with said inlet port (38) as well as from said outlet port (40) by said at least one rotor (54, 56); and valve means (36), selectively adjustable between two end positions, for formation of different flow paths, wherein in said first end position, said valve means (36) opens up a direct communication between said intermediate pressure channel (30) and said return channel (32) and opens said bleed port means (44), forming a first flow path as a by-pass flow path between said intermediate pressure channel (30) and said return channel (32), a second flow path between said working space (58) and said first flow path through said intermediate port means (42) and a third flow path between said working space (58) and said return channel through said bleed port means (44), and wherein in said second end position, said valve means (36) blocks said direct communication between said intermediate pressure channel (30) and said return channel (32) and closes said bleed port means (44), forming a flow path between said intermediate pressure channel (30) and said working space (58) through said intermediate port means (42).

* * * * *